US005868280A

United States Patent [19]

Schroeder

[11] Patent Number: 5,868,280

[45] Date of Patent: Feb. 9, 1999

[54] BLADDERLESS PRECHARGED PRESSURIZED LIQUID DELIVERY SYSTEM

[76] Inventor: David H. Schroeder, 362 Hawthorne St., Glen Ellen, Ill. 60137

[21] Appl. No.: 745,263

[22] Filed: Nov. 8, 1996

[51] Int. Cl.[6] ..... B67D 5/08; B67D 5/54

[52] U.S. Cl. ..... 222/64; 137/209; 137/192

[58] Field of Search ..... 222/61, 63, 67, 222/64, 396, 397; 137/206, 209, 207, 192; 417/36

[56] References Cited

U.S. PATENT DOCUMENTS

| | | | |
|---|---|---|---|
| 5,205,316 | 4/1993 | Pruett | 137/209 |
| 5,218,986 | 6/1993 | Farwell | 137/14 |
| 5,358,009 | 10/1994 | Cambell | 137/899 |

*Primary Examiner*—Andres Kashnikow
*Assistant Examiner*—David Deal
*Attorney, Agent, or Firm*—Keith Schoff

[57] ABSTRACT

Minimalized energy use and operational cost are provided by the method and apparatus of this invention for liquid distribution system in which pumped liquid is charged to a pneumatically pressurized storage tank, filling it to an optimum level for subsequent distribution of incremental quantities of liquid drawn from the tank, as typical for well water systems of rural residiences. A pneumatic pressure-head of nominally constant mass is maintained in a liquid storage tank during intermittent operations of filling and of discharging liquid from the storage tank, thereby neccesitating minimal venting or charging of air for mainting constancy of pneumatic mass in the tank.

10 Claims, 7 Drawing Sheets

FIG. 2 - Sensor Assembly

BLADDERLESS PRECHARGED PRESSURIZED LIQUID DELIVERY SYSTEM

BACKGROUND OF THE INVENTION the invention relates to a process and apparatus for delivery of a liquid under pressure. More particularly, but not by way of limitation, the liquid may be water pumped from a well or other source for delivery to residential or commercial users.

In common private water systems, water is pumped from a well to a pressure tank which is designed to maintain a supply of water under pressure for random usage patterns. The reason for the pressure tank is to eliminate the need for an elevated storage tank or the requirement for the pump to run continuously in order to instantly meet a demand for water.

Typical systems rely on compression of air in the tank to maintain pressure in the tank after the pump stops. The water pump introduces water into a closed tank compressing air in the tank until reaching a preset high pressure. A pressure operated switch disconnects the power to the pump at this pressure. After the water pump stops, water may be drawn from the tank under pressure of the compressed air. As water is removed from the tank, the air expands and the pressure drops until the pressure switch which controls the pump motor closes and starts the cycle again.

A problem with this type of system is the fact that some of the air is gradually dissolved into the water and must be replenished with either a venturi or bleeder valve arrangement. To make the system operate more efficiently, an air volume control is employed to manage the ratio of air to water in the tank. Another means of addressing the loss of air is to employ a diaphragm or bladder as a barrier between the air and water. The sealed air chamber may be precharged to a pressure which again adjusts the air to water ratio at given pressures for efficient operation.

The apparatus and process of prior art have several distinct disadvantages. First, if the pressure is increased on an installed system, the drawdown (volume of water that can be removed from the tank between cycles) is reduced. Since the drawdown volume is directly related to refill time, the pump may run for less than the manufacturer's recommended minimum run time and shorten the pump life. Second, the standard pressure switch differential is 20 PSI, and for many ordinary pressure switches the differential cannot be adjusted to half that or less; especially at higher pressures. Further, both type of systems currently in use are prone to a type of failure called water logging which causes the pump to cycle rapidly and often fail prematurely. In the case of standard hydropneumatic tanks a sticking air volume control valve or float causes an imbalance in the air to water ratio resulting in either rapid cycling or air being expelled into the water delivery lines. In the case of bladder or diaphragm tanks, the membrane separating the air from water is prone to perforation resulting in water logging. Also the precharge pressure in a diaphragm or bladder tank must be checked and adjusted at regular intervals in order to maintain proper air to water ratios.

There is a need for a system in which the drawdown volume does not vary when the operating pressure is adjusted, will permit a smaller differential in operating pressure, and will reliably maintain optimum air to water ratio.

SUMMARY OF THE INVENTION

The present invention includes both apparatus and method claims for a bladderless precharged pressurized liquid delivery system. The method or process of the present invention includes means of controlling the operation of the liquid pump on volume alone and independent of pressure so that the minimum pump run time to refill the liquid storage vessel will not decrease as the operating pressure is increased.

The process further provides a means for setting the desired constant drawdown volume to match pump characteristics at installation time, and provides a means for setting a predetermined reserve volume. The reserve volume is an allocation of water storage which can provide water delivery beyond the normal drawdown volume e.g. in the case of a power outage, or in the event of high draw flow rate which intermittently exceeds the flow rate of the liquid pump.

The process further provides a means of adjusting operating pressure to meet current user requirements, independent of drawdown volume. The process utilizes a control means to maintain optimum air to water ratio for maximum possible efficiency according to installation parameters on a continuing basis with no requirement for periodic check and adjustment. The process provides a means to select planned pressure deviation limits at installation and permit later reduction of deviation limit if desired. Finally, the process provides a means of preserving the precharge pressure over power outages and excess draw conditions without a diaphragm or bladder.

Apparatus is also claimed as part of the invention. The apparatus will include a sensor assembly which monitors the system operating parameters and provides information to the control unit; a zero differential pressure sensor which may provide visual feedback for easy adjustment; a control unit which contains logic to manage system operation according to the process described, and a conditional lockout valve to preserve the precharge.

DETAILED DESCRIPTION OF THE PREFERRED EMBODIMENT

Figure 1:
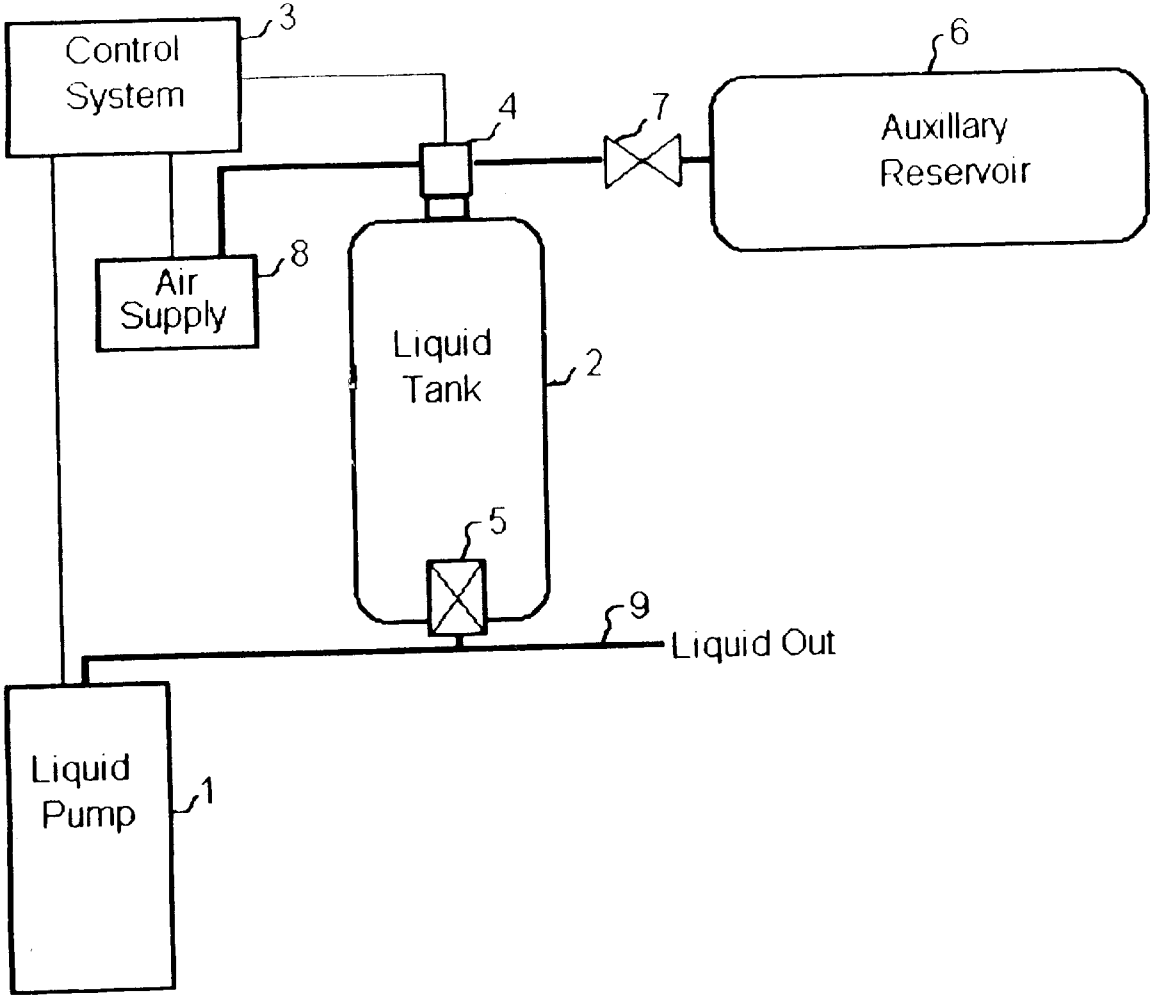
FIG. 1 is a schematic diagram depicting one embodiment of the entire system.

Referring to FIG. 1, a schematic diagram is shown which depicts one embodiment of the entire system. It should be noted that FIG. 1 depicts one auxiliary pneumatic reservoir vessel; however, less than one or more than one may be utilized according to installation requirements, and additional reservoirs may be added as desired while the process remains the same. It should also be noted that in this description the word water may be used for purposes of clarity, but the word water denotes the phrase "water or other liquid". Similarly, the word air denotes "air or other pneumatic fluid".

The control means 3 governs operation of the entire process. In the preferred embodiment the control logic is implemented with solid state digital integrated circuitry for compact size and high reliability; however there are other means of implementation of the same control logic. The sensor assembly 4 continuously sends digital status information on system conditions to the control means 3.

The primary tank or liquid vessel 2 is conceptually divided into three segments; one contains the volume of water for the reserve supply previously described, a second contains the drawdown volume determined by the pump 1 flow rate and the pump manufacturer's minimum run time, and the remaining space contains air. Any and all auxiliary reservoirs 6 contain only air, and therefore may be installed in either the horizontal or vertical position. Horizontally mounted auxiliary reservoir vessels 6 may utilize a dip tube to remove any possible condensation ensuring that the vessel contains only air. An optional air valve 7 allows an auxiliary reservoir 6 to be shipped with a precharge and permits servicing the system without loss of precharge.

The volume relationships between reserve capacity, drawdown capacity, and total system capacity determine the performance capability of the system. Volume segmentation choices depend on user performance requirements. Selection of ideal choices may be assisted by use of a computer program which takes into consideration the control means 3 logic, size of vessel 2, size of reservoir 6, volume of reserve supply, drawdown requirement, and user's operating pressure and regulation preference. Tables produced by the computer program may also be used.

The pneumatic supply 8 operating under control of the control means 3 provides a source of air to offset any loss of air in the system, and may be a small pneumatic pump or other source such as standing air or air derived from bleeder valves in the well.

Figure 2:
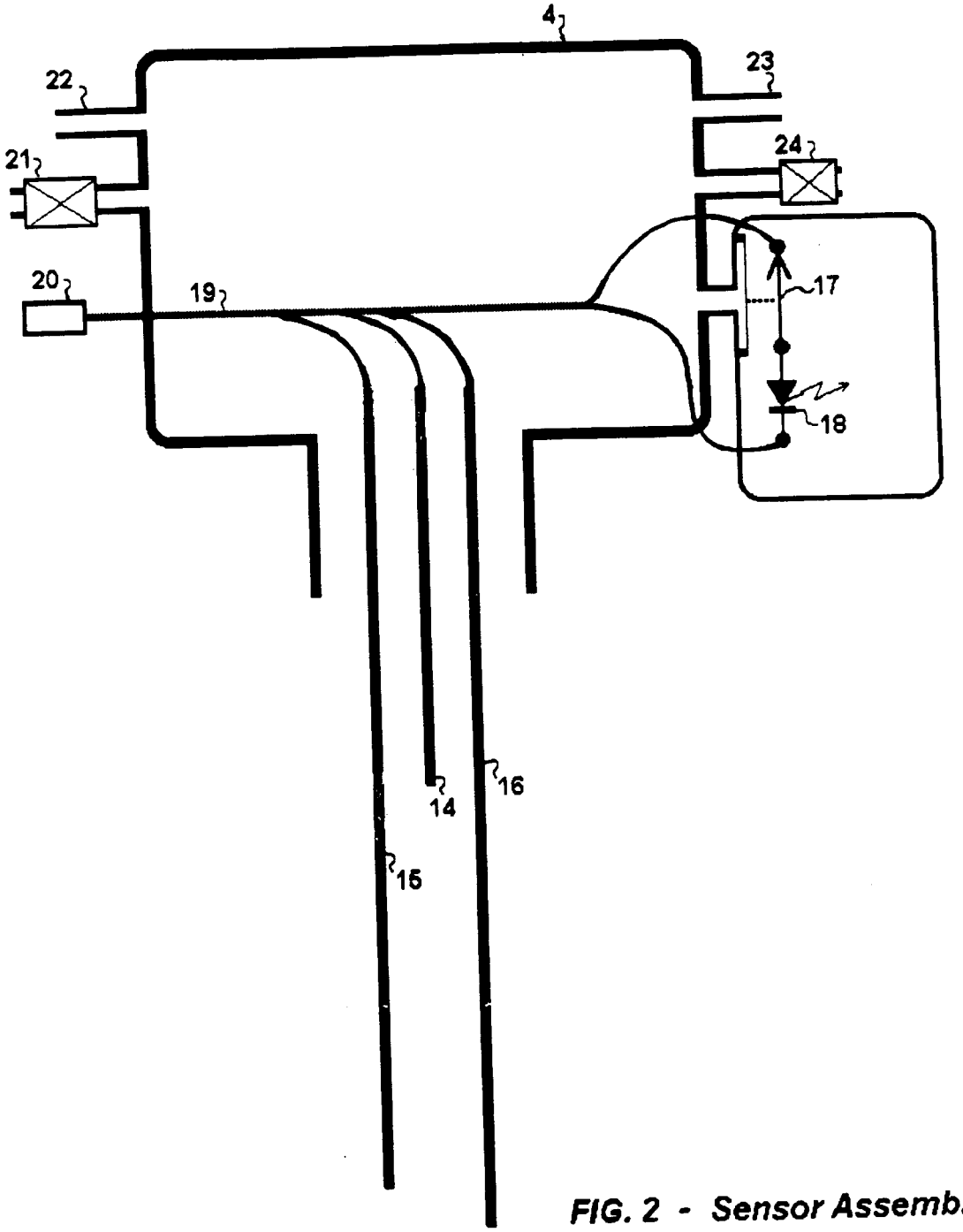
FIG. 2 is a schematic diagram depicting one embodiment of the sensor assembly.

Referring to FIG. 2, a schematic diagram is shown depicting one embodiment of the sensor assembly 4. The minimum elevational liquid level sensor 15 of the sensor assembly 4 is positioned to operate at the boundary of the reserve volume and the drawdown volume segments of the liquid vessel 2. The maximum elevational liquid level sensor 14 of the sensor assembly is positioned to operate at the boundary between the drawdown volume and the pneumatic segment of the liquid vessel 2. A reference electrode 16 establishes the zero reference level for the other sensor elements. A zero differential pressure operated adjustable normally closed switch 17 having substantially no deadband or hysteresis is used as a pressure sensor to provide feedback to the control means. A light emitting diode 18 in the pressure sensor circuit provides visual feedback when installing, adjusting, or diagnosing. Digital information from the sensors is transferred to the control means 3 via a multiconductor shielded data cable 19 through detachable connector 20.

The sensor assembly 4 body also serves as a pneumatic manifold providing ports for check valve 21 to pneumatic supply, connection to control unit 22, connection to auxiliary reservoirs 23, and air tank valve 24 for admission of initial precharge.

Figure 3:
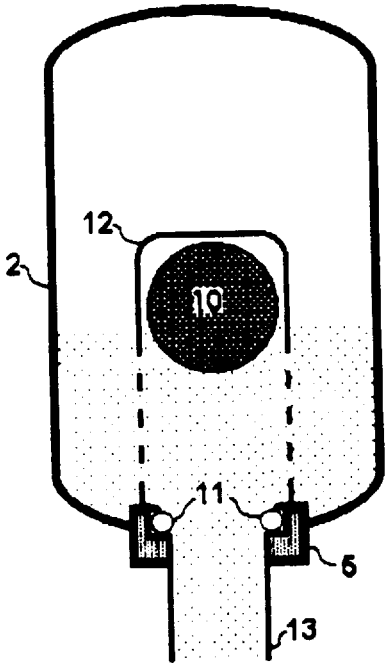
FIG. 3 is a diagram depicting a configuration of one embodiment of the conditional lockout valve.

FIG. 3 is a depiction of one embodiment of the conditional lockout valve 5. This valve is fitted to the bottom of the liquid vessel 2 but could also be located separately from the liquid vessel if a suitable enclosure is used and certain precautions are followed and proper adaptation is made. Referring to FIG. 3, an open cage 12 limits travel of sphere 10 and freely maintains its position directly above the inlet/outlet port 13 which is fitted with a seat 11. The sphere 10 is of lower density than the liquid under pressure.

OPERATION

Referring to FIG. 1, FIG. 2 and FIG. 3, the sequence of operation will now be explained. The control means 3 logic monitors digital information from the sensors 4. During normal operation, any time the water level falls below the drawdown volume/reserve volume boundary, minimum elevation liquid level sensor 15 sends a 1 level logic signal indication to the control means 3 which interprets it as a call for water and activates the liquid pump 1. The pump delivers water through the distribution line 9 satisfying any need for water. At any time the flow rate through the distribution line 9 is less than the flow rate of the pump at the current operating pressure, water will enter the liquid vessel 2 through the conditional lockout valve 5 ingress/egress connection 13, displacing sphere 10 from its seat 11. As the volume of water in the vessel increases, the water level will rise. As the water level rises, the sphere 10 being of lower density will begin to float upward until restrained by the upper limit of its cage 12. The liquid pump will continue to operate until the liquid vessel reserve volume is filled and the liquid vessel drawdown volume is filled, causing the water level to activate the maximum elevation liquid level sensor 14 which is read by the control means 3 as an indicator that the vessel 2 is optimally filled. After an optional fractional second delay to allow for liquid turbulence, the control means 3 deactivates the pump 1.

As the liquid vessel 2 is being filled with liquid, air trapped in the remainder of the liquid vessel 2 and any auxiliary vessel(s) 6 is compressed as the air volume diminishes. This system does not use an air volume control valve. Instead, the key to optimum performance and efficiency achieved by this system is maintenance of a substantially constant pneumatic mass for the chosen system operating parameters, regardless of current air pressure or air volume. Maintaining the pneumatic mass constant also assures that the operating pressure range will also remain constant. This part of the process is accomplished by logic which varies slightly depending on whether the well has bleeder valves installed to provide an air charge at the beginning of each pump cycle.

In the preferred embodiment using wells not containing bleeder valves, operation of pneumatic mass control is as follows: At a repeatable point in the operation cycle such as when the high elevation liquid level sensor 14 is activated signaling that the reserve volume and the drawdown volumes are filled, pressure sensor 17 is tested to compare the current system pressure to the pressure setting adjustment currently in effect for this system at this point in the operation cycle. If the control means 3 determines that system pressure is equal to the pressure setting, no action is taken. If system pressure is lower than the pressure setting, air mass has been lost. On detection of lost air mass, control means 3 will activate the pneumatic supply 8. A small pneumatic compressor or source of standing air can serve as the pneumatic supply. In the case of a pneumatic pump the control means can initiate compressor unloading as well as control compressor start and stop. Additional air from the pneumatic supply 8 enters the system through check valve 21 until the control means determines that the pneumatic mass has been replenished, causing the system pressure to rise to the preadjusted setting. The control means then deactivates the pneumatic supply. During the period of pneumatic mass replenishment, control means 3 continues to monitor system status for any change in the operating cycle. If there is any change in the operating cycle during the replenishment process, for example water being drawn from the distribution line 9, then the comparison becomes invalid due to changed conditions and an alternate algorithm is employed. In this case the control means 3 causes the pneumatic supply 8 to remain activated for a predetermined time based on experience estimated to provide the required correction to pneumatic mass. If there is any small error, it will be corrected in subsequent operating cycles by the primary algorithm.

The pneumatic mass control algorithm is modified for wells containing bleeder valves as follows: At the beginning of each operation cycle, liquid pump 1 operation causes air in the well piping to be expelled into the system. Air separation apparatus either inside the liquid vessel 2 or external to the liquid vessel causes the expelled air to be collected at the top of the vessel, increasing the pneumatic mass by an amount usually just slightly more than required to offset pneumatic mass losses. Control means 3 continuously monitors system pressure data from pressure sensor 17. If current system pressure ever exceeds the pressure setting adjustment currently in effect for this system the control means correctly interprets this as excess pneumatic mass and opens a valve porting air to the atmosphere until correct pneumatic mass has been restored.

For either variety of well, when either the draw flow rate through distribution line 9 exceeds the liquid pump 1 flow rate capacity or the liquid pump is inoperative due to failure or power loss, the reserve volume is utilized to provide a limited extension of liquid delivery. When the full amount of the reserve capacity has been removed from the vessel 2 sphere 10 will no longer float and will settle to seat 11 closing inlet/outlet port 13 to preserve integrity of the precharged pneumatic mass. At any time the flow rate is restored to the point where pressure at the inlet/outlet port is equal to or greater than the internal vessel pressure, sphere 10 will begin to rise to the top of restraining cage 12 allowing bi-directional flow through the conditional lockout valve 5.

Figure 4:
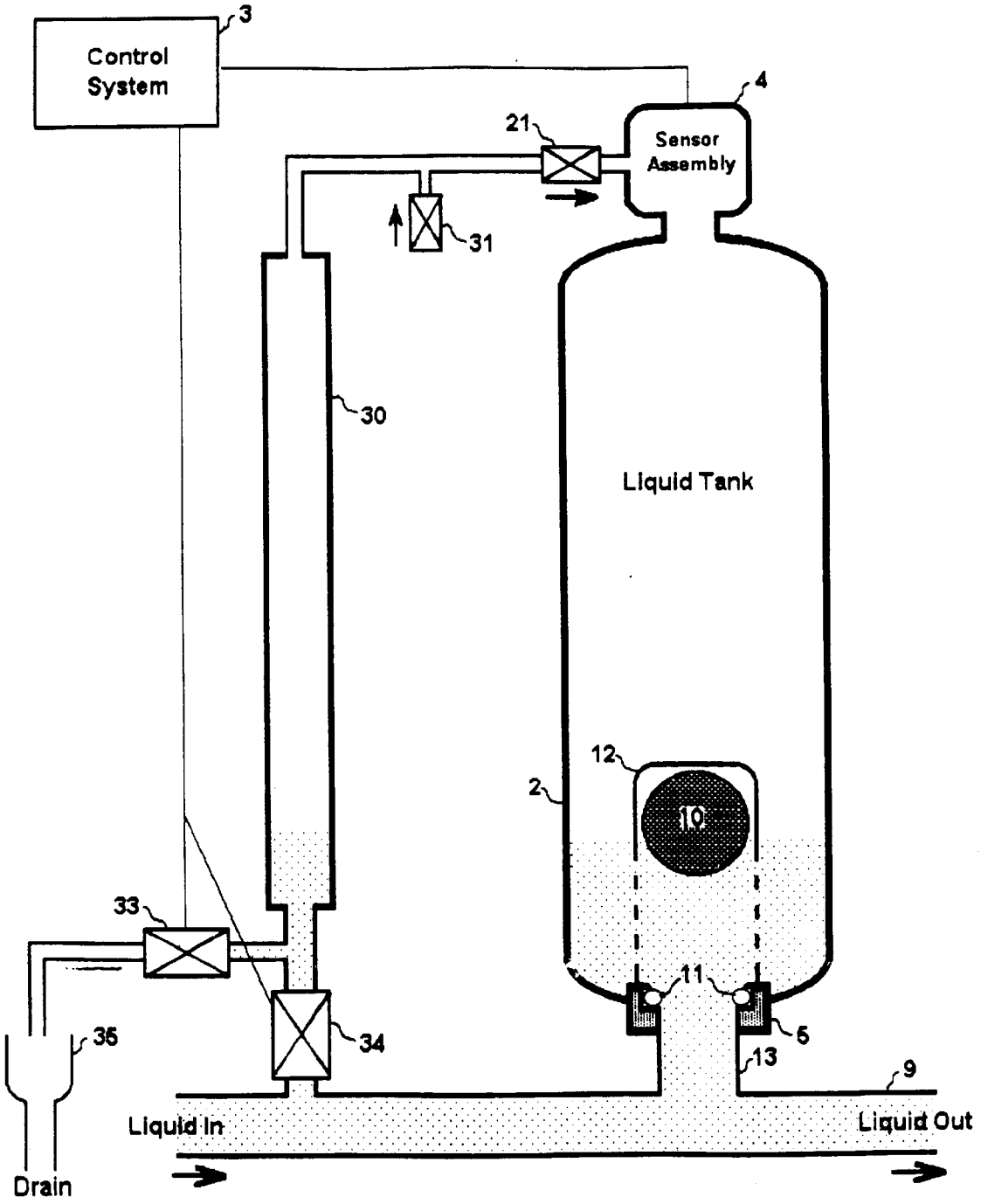
FIG. 4 is a diagram depicting one means of supplying pressurized air to replace lost air mass.

Referring to FIG. 4, details of one embodiment of the pneumatic supply are shown. For clarity, the liquid pump and auxiliary vessel(s) are not shown in FIG. 4. In this configuration, the liquid vessel 2 and associated conditional lockout valve 5 and sensor assembly 4 components operate as previously described.

When the control means 3 logic determines a need for air using algorithm previously described, the control means opens drain valve 33. Any liquid in the pneumatic supply tube 30 is permitted to drain through open drain valve 33 through an air break 36 to waste drain. As water drains from pneumatic supply tube 30 by gravity, atmospheric pressure air is permitted to enter supply tube through low crack pressure check valve 31 (sometimes termed snifter valve) replacing drained water.

Air at system operating pressure is prevented from entering the supply tube from the liquid vessel 2 or auxiliary vessels by check valve 21. Similarly, the control unit maintains valve 34 in the closed position to prevent high pressure liquid from the pump or liquid vessel from entering the pneumatic supply tube. Dimensions of the pneumatic supply tube are selected to provide an adequate pneumatic volume for the size of liquid vessel and system operating pressure.

When the drain period is completed, the control means 3 logic causes drain valve 33 to close and pneumatic supply valve 34 to open. (Note that in an alternate embodiment a singe three way valve may be used to combine the function of two way valves 33 and 34). When pneumatic supply valve 34 is opened at high system pressure, air in supply tube 30 is compressed to high system pressure by liquid displacement through valve 34 after which valve 34 is closed. As liquid is used from the liquid vessel 2, high pressure air from the supply tube is permitted to enter the liquid vessel and any associated auxiliary vessels through check valve 21.

Figure 5:
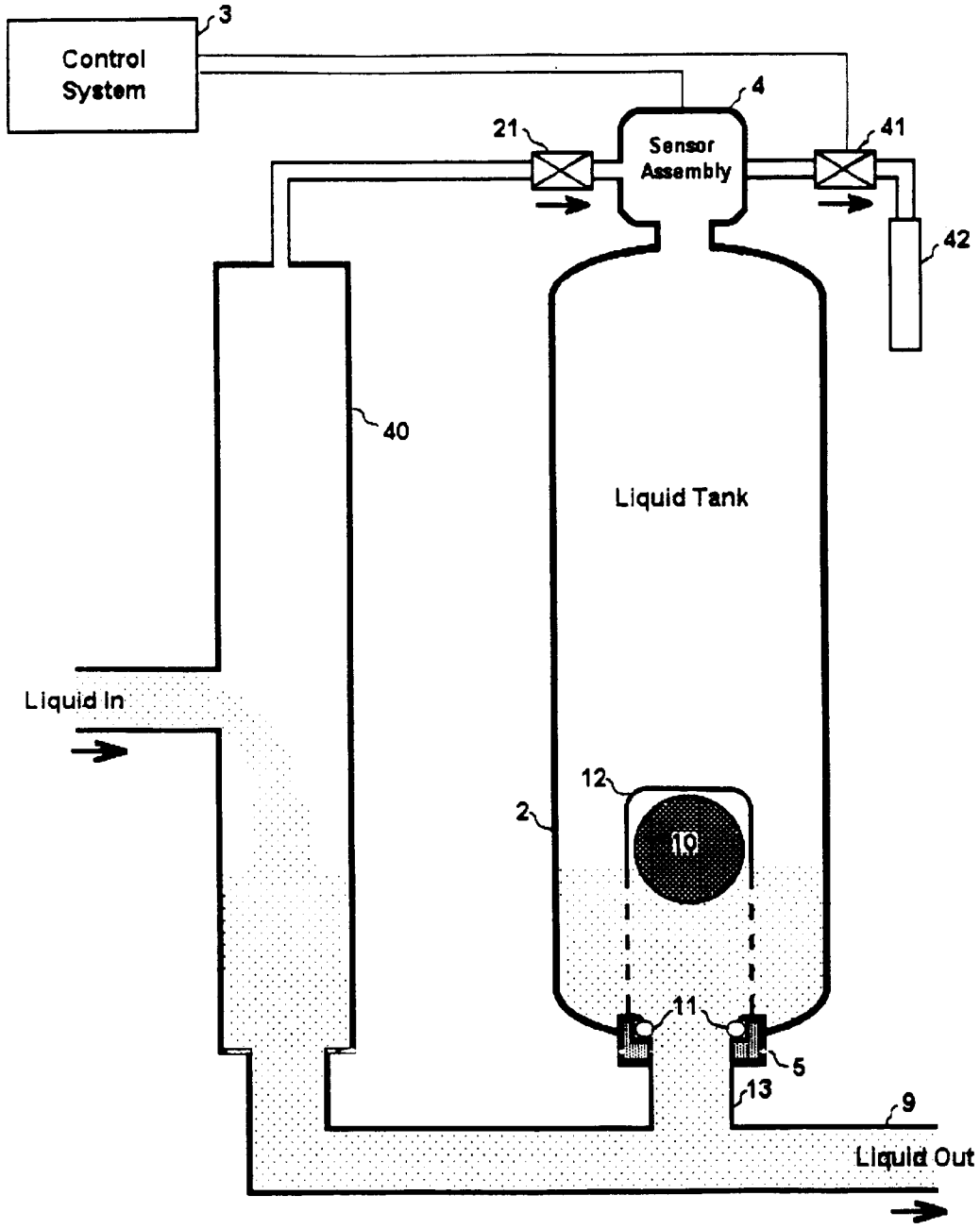
FIG. 5 is a schematic diagram depicting operation of an air separator column as an air supply for wells with bleeder valves.

Referring to FIG. 5, an embodiment of the process and apparatus is shown wherein the pneumatic supply is provided by a combination of conventional bleeder valves in the well and an air separator column. Due to the action of a check valve in the well, a pair of bleeder valves located below the check valve permits a limited quantity of water to drain from the pipe extending to a submerged pump when the pump is not running. The drained water is replaced by atmospheric pressure air, which is then compressed and forced into the incoming water line when the pump starts. When this mixture of water and air enters the separator column 40, air rises to the top of the column and water in the lower portion is forced into the liquid vessel 2 inlet/outlet 13. In the steady state the level of water in the separator column will be at the same level as the water in the liquid vessel, with any excess air entering the separator column having the opportunity to pass through check valve 32 into the liquid vessel. As previously described, control means 3 monitors information from the sensor assembly 4 and releases any excess air entering from check valve 21 through valve 41 and optional silencer 42 in order to maintain constant pneumatic mass.

Should the liquid in line ever lose pressure due to power failure or other cause, precharge in the liquid vessel and any associated auxiliary pneumatic vessels will be preserved by the action of air check valve 21 and conditional lockout valve 5 after any remaining draw volume and all reserve volume of liquid has been exhausted.

Figure 6:
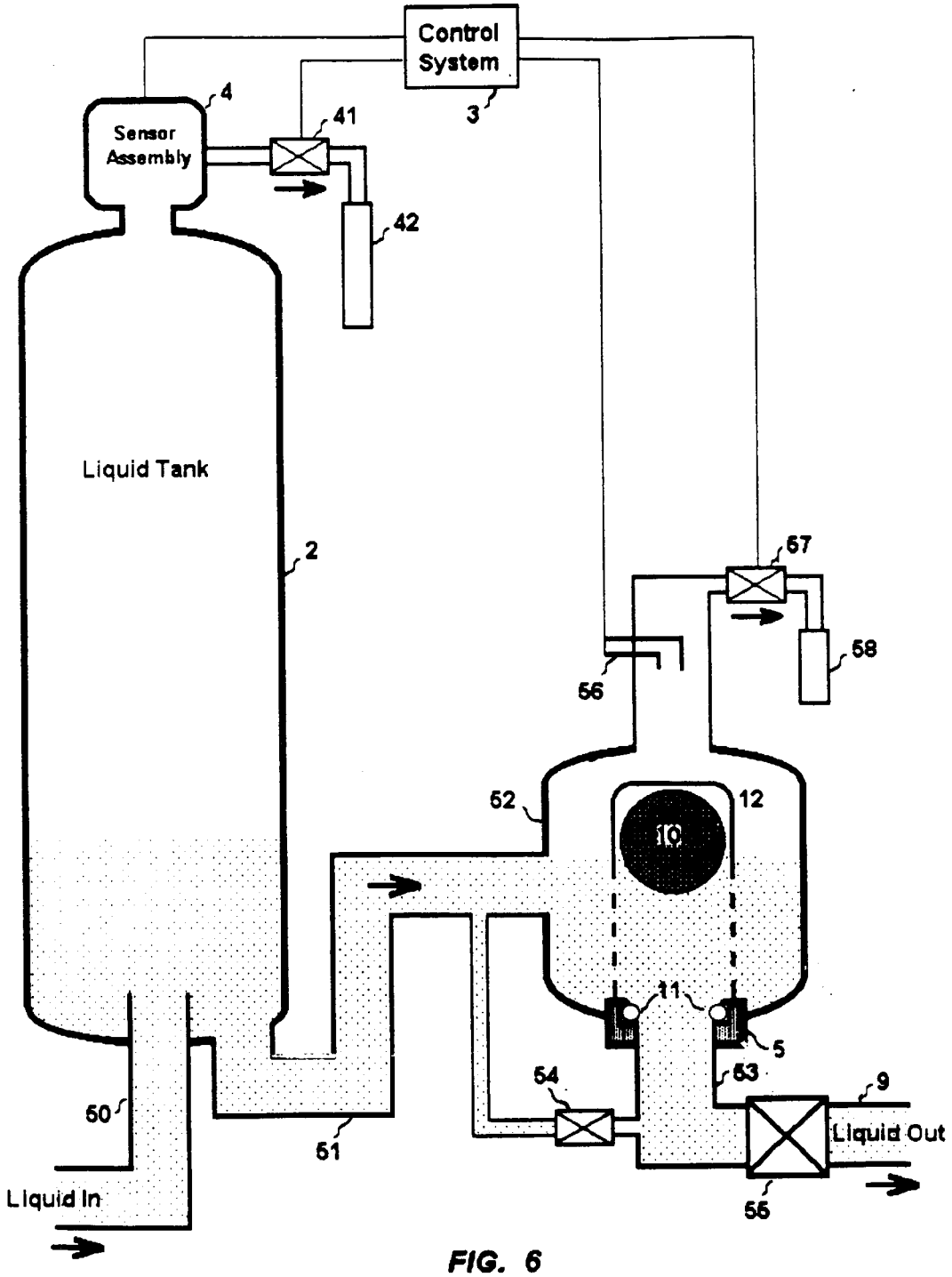
FIG. 6 is a diagram depicting one arrangement for use of the conditional lockout valve external to the liquid vessel.

FIG. 6 depicts an embodiment of the process and apparatus wherein it is impractical to locate the conditional lockout valve in the liquid vessel, such as when retrofitting to an existing buried tank. In this case the conditional lockout valve 5 may be located in the base of an independent small vessel 52. The outlet of liquid vessel 2 is connected to the inlet of lockout vessel 52. To prevent an airlock occurring from small quantities of air accumulating over time at the top of vessel 52, sensors 56 alert the control means to release excess air via valve 57 and optional silencer 58 only if there is excess air at the top of the vessel but the vessel is still filled with liquid. Air release could also be accomplished by a manually operated valve or an automatic float valve located at the top of vessel 52. If for any reason, such as a power failure, the rate of liquid flow entering vessel 52 through inlet connection 51 is less the rate of flow entering the liquid vessel 2 through inlet 50 to the point where the liquid level in vessel 52 drops to near the valve seat 11, the conditional lockout valve will close to protect the precharged pneumatic mass. Once lockout valve 5 is closed, and pressure is lost at the vessel outlet 53, it will be necessary to temporarily open bypass valve 54 once the liquid level has been restored in vessel 2 in order to equalize pressure and re-float the sphere 10. Distribution line 9 valve 55 may have to be closed temporarily as well if liquid is being used from the distribution line 9. Valves 54 and 55 may be operated manually or under control of the control means. A similar bypass arrangement of valves 54 and 55 could be used in any case where the liquid vessel 2 has a lockout valve installed but uses separate inlet and outlet orifices such as when pneumatic separation is performed internally rather than externally.

Figure 7:
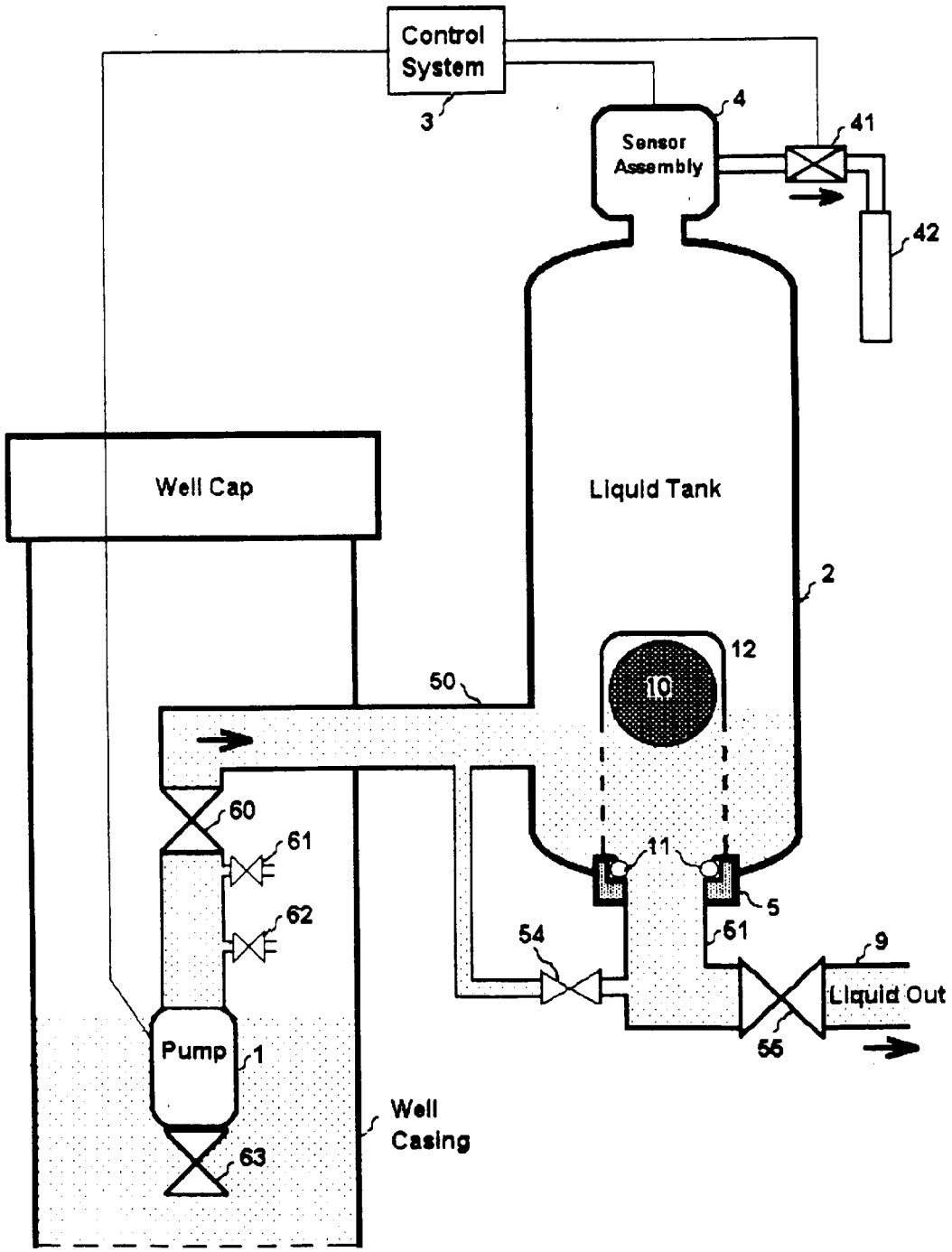
FIG. 7 is a schematic diagram depicting one embodiment of the entire system when bleeder valves are installed in the well.

Referring to FIG. 7, operation of an embodiment of the process and apparatus is shown wherein the pneumatic supply is provided by air from bleeder valve operation in the well admitted directly into the liquid vessel 2. For clarity, auxiliary pneumatic reservoirs are not shown in this figure. When control means 3 turns off liquid pump 1 check valve 60 installed in the line between the pump and vessel 2 liquid in line 50 closes to prevent vessel pressure from being reflected back to the pump. At this time bleeder valves 61 and 62 installed in the pipe between the check valve and pump will open on being relieved of pressure. Water drains from valve 62 by force of gravity, permitting air to enter valve 61. The distance between the valves and the diameter of pipe connecting the valves determines the quantity of air that may enter. Check valve 63 (sometimes called a foot valve) installed in the pump or at the base of the pump prevents water draining lower than bleeder valve 62 and thereby controls the maximum amount of air entering the pipe. When pump 1 is restarted by control means 3, liquid pumped by the pump compresses the air forcing valves 61 and 62 to close and valve 60 to open permitting air and water in inlet line 50 to enter liquid vessel 2. Inlet line 50 enters the vessel 2 at a different location from outlet 13 to permit air separation within the vessel and prevent air from traveling with water to distribution line 9. Because the inlet and outlet lines are separated, a bypass valve 54 is employed as previously described to equalize pressure in inlet line 50 and outlet line 13 to recover in the event of a possible loss of pressure through distribution line 9. Control means 3 monitors operation using input from sensor assembly 4 as previously described using algorithm to maintain constant pneumatic mass, releasing excess air from the bleeder valves to the atmosphere through valve 41 and silencer 42.

Thus, it is seen that the apparatus and methods of the present invention readily achieve the ends and advantages mentioned as well as those inherent therein. While preferred embodiments of the invention have been illustrated and described for the purposes of the present disclosure, numerous changes in the arrangement and construction of parts and steps may be made by those skilled in the art, which changes are encompassed within the scope and spirit of the present invention as defined by the appended claims.

I claim:

1. In a liquid delivery system embodying at least one vessel containing pressurized fluids which is provided with fluid filling means and valved discharge means, and with which is communicated liquid level sensing and control means, pneumatic pressure sensing and control means, liquid pump, and pressurized pneumatic supply, an improved process for minimizing operational and energy costs, comprising the steps of:

(a) operating said liquid pump for a time period not less than that which, if any, is recommended for operational protection, to partially fill said vessel with liquid;

(b) sensing and controlling the elevational level of liquid in said vessel during filling to a pre-determined maximum level;

(c) sensing pneumatic pressure in said vessel;

(d) adjusting pneumatic pressure in said vessel, if necessary, utilizing said pneumatic supply, to a pre-charge constant pueumatic mass value, dependent on the elevational level of liquid in said vessel;

(e) sensing and controlling the liquid elevational level in said vessel to a pre-determined minimum level during drawdown;

(f) preventing uncontrolled gas escape from said vessel by the rate of liquid drawdown exceeding that of liquid refilling or by other cause, by operation of a float-biased conditional lockout valve to check discharge flow of liquid from said vessel;

(g) repeating liquid refilling of said vessel to replace liquid drawdown volume exactly, thereby conserving pneumatic head pressure and mass in said vessel with minimal gas replenishment.

2. Apparatus for delivery of pressurized liquid comprising;

(a), at least one bladderless vessel for containing pressurized fluids, said vessel being provided with ingress and egress passages for flow of gas and for flow of liquid;

(b) a first liquid-level sensor disposed within said vessel for sensing and signaling attainment of a pre-determined operational maximum liquid elevational level in said vessel;

(c) a second liquid-level sensor disposed within said vessel for sensing and signaling attainment of a pre-determined operational minimum liquid elevational level in said vessel;

(d) a liquid pump for charging liquid into said vessel;

(e) a pneumatic pressure sensor for measuring pneumatic pressure in said vessel;

(f) a pressurized pneumatic source for charging said vessel above the elevational level of liquid therein;

(g) a conditional lockout valve disposed to control fluid flow through liquid egress passage, said valve comprising float biased means for checking flow of fluid from said vessel when the elevational level of liquid in said vessel is less by a pre-set distance than said pre-determined operational minimum liquid elevational level;

(h) means controlling said liquid pump to terminate filling operation of said vessel responsively to signal generation by said first liquid-level sensor;

(i) means controlling said liquid pump to commence filling operation of said vessel responsively to signal generation by said second liquid-level sensor;

(j) means controlling said pneumatic source to maintain pneumatic pressure and mass in said vessel responsively to signal generation by said pneumatic pressure sensor, thereby minimizing capital and operational costs and energy expenditure by maintaining operational pre-charge pneumatic pressure and mass in said vessel.

3. The apparatus of claim 2 wherein said pressurized pneumatic source comprises a pneumatic pump.

4. The apparatus of claim 2 comprising in addition at least one auxiliary vessel communicated to said one bladderless vessel for providing volumetric increase in fluid capacity in said system.

5. The apparatus of claim 2 wherein said means for controlling said liquid pump and said pneumatic source comprises algorithmically programmed operation.

6. The process of claim 1 wherein said pneumatic fluid is air.

7. The process of claim 1 wherein said liquid is water.

8. The process of claim 1 wherein pneumatic fluid within said vessel is maintained at pressures selected to provide substantially constant pneumatic mass in said bladderless vessel throughout system operation.

9. The process of claim 1 wherein said fluid filling, operating, adjusting, and sensing and controlling functions are effected using algorithm programmed means.

10. The apparatus of claim 2 wherein the conditional lockout valve comprises float biased means for checking flow of fluid from said vessel when the elevational level of liquid in said vessel is less by a pre-set distance than said pre-determined operational minimum liquid elevational level.

* * * * *